US009682495B2

(12) United States Patent
Highfill et al.

(10) Patent No.: US 9,682,495 B2
(45) Date of Patent: Jun. 20, 2017

(54) METHOD AND APPARATUS FOR PROCESSING SAPPHIRE

(71) Applicant: GTAT Corporation, Merrimack, NH (US)

(72) Inventors: James N. Highfill, St. Louis, MO (US); Scott Huard, Weare, NH (US)

(73) Assignee: GTAT Corporation, Merrimack, NH (US)

( * ) Notice: Subject to any disclaimer, the term of this patent is extended or adjusted under 35 U.S.C. 154(b) by 38 days.

(21) Appl. No.: 14/488,715

(22) Filed: Sep. 17, 2014

(65) Prior Publication Data

US 2015/0090245 A1 Apr. 2, 2015

Related U.S. Application Data

(60) Provisional application No. 61/884,683, filed on Sep. 30, 2013.

(51) Int. Cl.
*B28D 5/00* (2006.01)

(52) U.S. Cl.
CPC ..... *B28D 5/0058* (2013.01)

(58) Field of Classification Search
CPC ..... B28D 5/0058
See application file for complete search history.

(56) References Cited

U.S. PATENT DOCUMENTS 3,898,051 A * 8/1975 Schmid ..... C30B 11/003 117/83
5,013,380 A * 5/1991 Aoshima ..... C30B 33/00 156/250
5,720,271 A * 2/1998 Hauser ..... B28D 5/0088 125/13.01
5,904,136 A * 5/1999 Nagatsuka ..... B28D 5/045 125/16.02
6,159,284 A * 12/2000 Olkrug ..... B24B 47/22 117/201
8,259,901 B1 * 9/2012 Kamireddi ..... B23D 59/001 378/73
2004/0168682 A1 * 9/2004 Hammer ..... B28D 5/0088 125/16.01
2014/0080081 A1 * 3/2014 Prest ..... F27D 17/004 432/94

FOREIGN PATENT DOCUMENTS

KR 10-1064266 B1 9/2011

OTHER PUBLICATIONS

International Search Report dated Dec. 23, 2014 issued in connection with PCT/US2014/056045.

* cited by examiner

*Primary Examiner* — Joseph J Hail
*Assistant Examiner* — Marc Carlson
(74) *Attorney, Agent, or Firm* — Parker Ibrahim & Berg LLC; Stephen D. LeBarron

(57) ABSTRACT

A method of producing a sapphire product from a suitable precursor material is disclosed. The method comprising the steps of placing a sapphire product precursor on a support apparatus of a crystalline material processing assembly further comprising at least one cutting tool and two or more x-ray module fixedly positioned around the product precursor. The support apparatus can be tilted and rotated in order to align the crystalline plane orientations to a fixed cutting direction, and the sapphire product can be produced by cutting in that direction.

17 Claims, 2 Drawing Sheets

METHOD AND APPARATUS FOR PROCESSING SAPPHIRE

CROSS-REFERENCE TO RELATED APPLICATION

The present application claims the benefit of U.S. patent application Ser. No. 61/884,683 filed Sep. 30, 2013, which is incorporated herein by reference.

BACKGROUND OF THE INVENTION

1. Field of the Invention

The present invention relates to processing of crystalline materials, particularly sapphire.

2. Description of the Related Art

Crystal growth apparatuses or furnaces, such as directional solidification systems (DSS) and heat exchanger method (HEM) furnaces, involve the melting and controlled resolidification of a feedstock material, such as alumina or silicon, in a crucible to produce an ingot. Production of a solidified ingot from molten feedstock occurs in several identifiable steps over many hours. For example, to produce an ingot, such as a sapphire ingot, by the HEM method, solid feedstock, such as alumina, is provided in a crucible containing a monocrystalline seed (which comprises the same material as the feedstock but with a single crystal orientation throughout) placed into the hot zone of a solidification furnace. A heat exchanger, such as a helium-cooled heat exchanger, is positioned in thermal communication with the crucible bottom and with the monocrystalline seed. The feedstock is then heated to form a liquid feedstock melt, without substantially melting the monocrystalline seed, and heat is then removed from the melted feedstock by applying a temperature gradient in the hot zone in order to directionally solidify the melt from the unmelted seed. By controlling how the melt solidifies, a crystalline material having a crystal orientation corresponding to that of the monocrystalline seed, and having greater purity than the starting feedstock material, can be achieved.

The sapphire material produced in a crystal growth furnace, often called a boule, takes the shape of the crucible that was used. Typically, sapphire is crystallized in a crucible having a circular cross-sectional shape since this geometry generally results in a more consistent temperature distribution. After growth is complete, the boule is then removed from the crucible and further processed, such as cutting, slicing sawing, grinding, or polishing, to provide sapphire products needed for a variety of applications, such as wafers used as a substrate in several types of electronic devices.

However, as is known in the art, sapphire includes one of several different crystalline axes, such as the c-axis, the m-axis, or the a-axis, and the properties of sapphire vary depending on this crystal orientation. Identifying the proper crystal orientation for a particular application and aligning the sapphire boule to be processed in the proper direction relative to that orientation is both difficult and time consuming, particularly for a boule having a circular cross-sectional shape. Processes are known in which a sapphire boule is placed on a platform and an x-ray module (comprising an x-ray source and detector) positioned at the appropriate Bragg angle for a desired crystal orientation, is used to measure the orientation of the crystal relative to the processing direction. However, such processes are a 2-dimentional analysis, identifying only one crystal plane and orienting the boule along this plane for processing. No additional crystal orientations are considered, and these are often at least as critical to producing sapphire parts having optimized properties. Additionally, proper 3-dimensional orientation cannot be verified, particularly since the shape of a sapphire boule does not necessarily align with the planar axes.

Therefore, there is a need in the industry for improved processes and apparatuses for identifying and aligning a crystalline material, such as a sapphire boule, relative to a processing direction in all three dimensions.

SUMMARY OF THE INVENTION

The present invention relates to a method of producing a sapphire product from a sapphire product precursor, such as a sapphire boule. The method comprises the steps of providing a sapphire product precursor having a first crystalline plane orientation and a second crystalline plane orientation and a crystalline material processing assembly. The assembly comprises at least one cutting tool configured to cut the sapphire product precursor along a fixed cutting direction, a first x-ray module fixedly positioned at a first angle relative to the fixed cutting direction, and a second x-ray module fixedly positioned at a second angle relative to the fixed cutting direction. The first x-ray module is configured to determine alignment of the first crystalline plane of the sapphire product precursor to the fixed cutting direction and the second x-ray module is configured to determine alignment of the second crystalline plane of the sapphire product precursor to the fixed cutting direction. The crystalline material processing assembly further comprises a support apparatus for the sapphire product precursor tiltable and rotatable relative to the fixed cutting direction. The method further comprises the steps of placing the sapphire product precursor on the support apparatus in a position to be cut by the cutting tool along the fixed cutting direction, establishing alignment of the first crystalline plane and of the second crystalline plane of the sapphire product precursor with the fixed cutting direction; and cutting the sapphire product precursor along the fixed cutting direction to produce the sapphire product. Various embodiments of this method are described below. The present invention further relates to the crystalline material processing assembly used in this method.

It is to be understood that both the foregoing general description and the following detailed description are exemplary and explanatory only and are intended to provide further explanation of the present invention, as claimed.

DETAILED DESCRIPTION OF THE INVENTION

Figure 2:
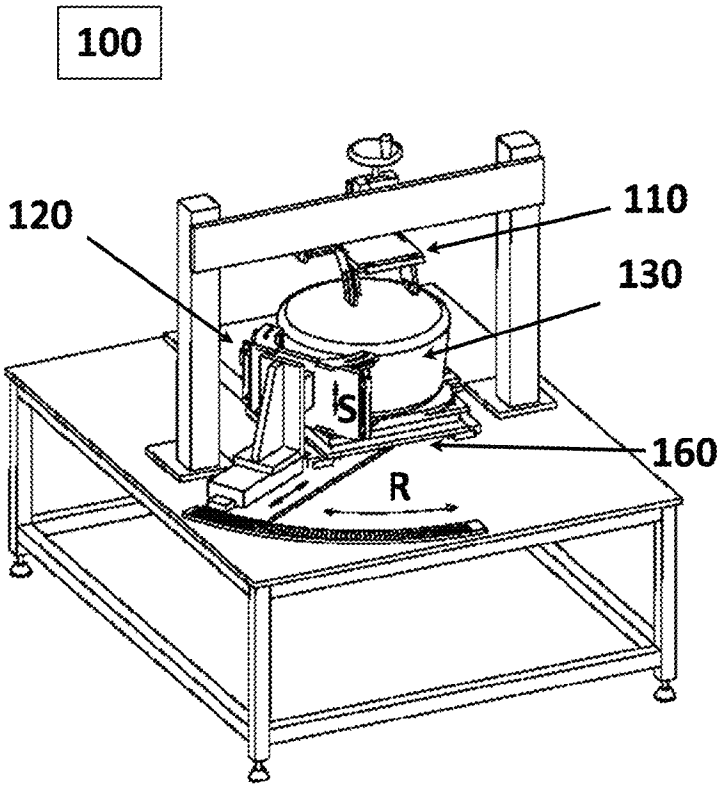
FIG. 1 and FIG. 2 show a specific embodiment of the crystalline material processing assembly of the present invention.

The present invention relates to the processing of crystalline materials, and, in particularly, to producing a sapphire product having proper 3-dimensional crystal orientation from a sapphire product precursor.

In the method of the present invention, a crystalline product precursor, such as a sapphire product precursor, is provided that is intended to be processed to produce a crystalline product, such as a sapphire product, including a wafer or sheet. In particular, the precursor can be a bulk sapphire material and is preferably substantially monocrystalline, having the same crystal orientation throughout, and can be prepared using any method known in the art. For example, the precursor to the sapphire product can be a bulk sapphire crystal that has been prepared in a crystal growth apparatus, which is a high-temperature furnace capable of heating and melting solid feedstock, such as alumina, in a crucible at temperatures generally greater than about 1000° C., including greater than about 2000° C., and subsequently promoting resolidification of the resulting melted feedstock material to form a crystalline material, such as a sapphire boule. Preferably, the sapphire product precursor is prepared in a heat exchanger method crystal growth furnace, in which a crucible comprising alumina feedstock and at least one single crystal sapphire seed is heated above its melting point to melt the feedstock without substantial melting of the seed, and the heat is then removed from the crucible using a heat exchanger, such as a helium-cooled heat exchanger, provided in thermal communication with the bottom of the crucible and positioned under the seed. This method has been shown to produce large, high quality sapphire bodies, sometimes referred to as boules, from which the sapphire layers can be removed. Also, the sapphire product precursor can be a portion of such a sapphire boule, including a sapphire brick or cylindrical core that has been sawn or cut from a larger sapphire boule.

In addition to the sapphire product precursor, a crystalline material processing assembly is also provided in the method of the present invention. The assembly can comprise any type of equipment configured to process the precursor along a defined direction to thereby produce the desired sapphire product. For example, the processing assembly can cut, slice, saw, drill, grind, and/or polish the sapphire product precursor. Preferably the processing assembly comprises at least one cutting tool, such as a wire saw or band saw, that cuts or slices the sapphire product precursor along a fixed cutting direction. For example, the processing assembly can be used to core or brick the sapphire product precursor, thereby producing a cylindrical or rectangular prismatic shaped sapphire product.

The crystalline material processing assembly further comprises at least two, such as two or three, x-ray modules that are each configured to determine the alignment of various crystalline planes of the sapphire product precursor relative to a direction of processing. The x-ray modules comprise at least one source of x-rays aimed into the sapphire material and at least one corresponding x-ray detector positioned to measure the intensity of the x-ray signal. While one x-ray source/detector combination is generally sufficient to identify the alignment of a crystal plane, it is preferred to use two, set perpendicular to each other, for improved accuracy. In the method of the present invention, a first x-ray module is fixedly positioned at a first angle relative to a desired processing direction and a second x-ray module is fixedly positioned at a second angle relative to the processing direction. For each module, the angle is the so-called Bragg angle for the specific crystalline plane orientation. For example, for cutting through a sapphire boule in a direction perpendicular to the bottom of the boule, to thereby provide a vertical cut, the first x-ray module can be positioned above the boule and configured to determine alignment of a crystalline plane that is perpendicular to the cutting direction (and parallel to the boule bottom) while the second x-ray module can be positioned on the side of the boule and configured to determine alignment of a crystalline plane that is parallel to the cutting direction.

The processing assembly further comprises a support apparatus upon which the sapphire product precursor is placed. The support apparatus is both tiltable, able to be raised and lowered in multiple directions, and is further able to be rotated. For example, the support apparatus may be, or may comprise, a table or other flat surface upon which a sapphire boule can be positioned. The table or surface can be tilted in various directions out of parallel with the plane of the table or surface and can also be rotated in the plane of the table or surface. In this way, 3-dimensional repositioning of the boule is provided.

In the method of the present invention, the sapphire product precursor is placed on the support apparatus in a position that is desired for the type of processing. For example, the precursor material is positioned on the support apparatus along the path of a cutting tool. Once positioned, alignment of the crystalline planes of the sapphire product precursor with the fixed cutting direction is established, such as by tilting and rotating the support apparatus. Once the desired or targeted alignment is achieved, the sapphire product precursor is processed (for example, cut with a wire saw) to thereby produce the sapphire product. By using a crystalline material processing assembly comprising a cutting tool, at least two appropriately positioned x-ray modules, and a tiltable and rotatable support apparatus, it is possible to align multiple crystalline planes of a sapphire material, including the c-plane, the a-plane, r-plane, or m-plane, with a preset cutting direction in a way that has not heretofore been possible.

Figure 1:
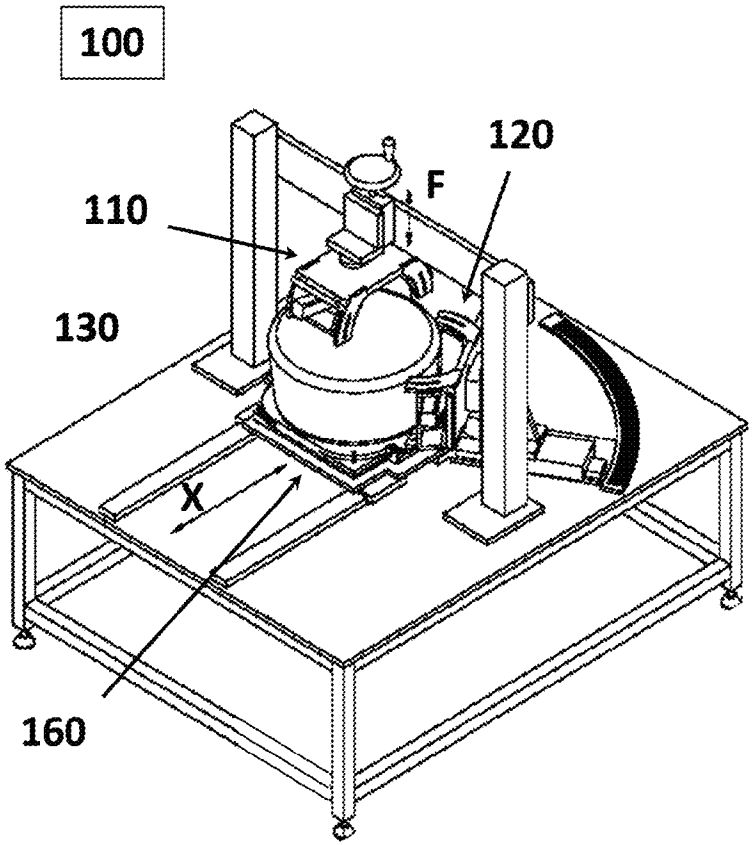

A specific embodiment of the crystalline material processing assembly used in the method of the present invention is shown in FIG. 1 and FIG. 2 and discussed below. However, it should be apparent to those skilled in the art that these are merely illustrative in nature and not limiting, being presented by way of example only. Numerous modifications and other embodiments are within the scope of one of ordinary skill in the art and are contemplated as falling within the scope of the present invention. In addition, those skilled in the art should appreciate that the specific configurations are exemplary and that actual configurations will depend on the specific system. Those skilled in the art will also be able to recognize and identify equivalents to the specific elements shown, using no more than routine experimentation.

An embodiment of crystalline material processing assembly 100 is shown if FIG. 1 and FIG. 2 and comprises first x-ray module 110 positioned above sapphire boule 130 and second x-ray module 120 positioned beside the sapphire boule. While only one source/detector combination is shown, it is to be understood that a second combination may be preferred for more accurate crystal orientation determination. As shown, both first x-ray module 110 and second x-ray module 120 can be positioned at varying heights, F and S respectively, depending on the size of sapphire boule 130. Furthermore, second x-ray module 120 can also be positioned anywhere around the boule at a range of angles, indicated by arrow R. However, when the boule is cut along fixed cutting direction X, both first x-ray module 110 and second x-ray module 120 are locked in place. Sapphire boule 130 is positioned on support apparatus 160, which can be tilted in various directions parallel to the bottom of the boule and can further be rotated around the center axis of the boule.

Figure 3:
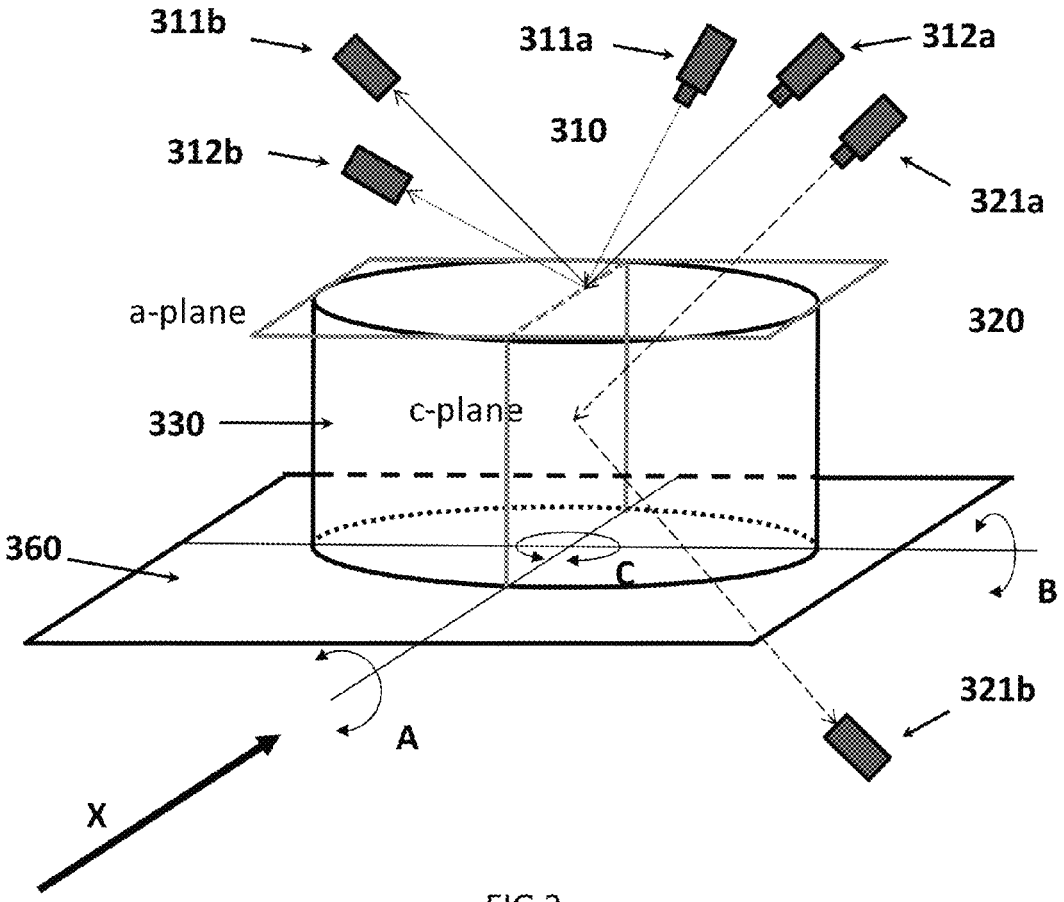
FIG. 3 shows a specific embodiment of the method of the present invention.

A specific embodiment of the method of the present invention is shown schematically in FIG. 3. Thus, sapphire boule 330, grown in a HEM furnace using an appropriate seed to grow in the a-direction, is placed on support apparatus 360. Since the a-plane orientation is parallel to the bottom of the boule, based on how it was grown, support table 360 is tilted along axes A and B until a maximum signal is measured using first x-ray module 310, comprising a pair of x-ray sources (311*a* and 312*a*) and x-ray detectors (311*b* and 312*b*) in fixed positions above the boule. In this way, the a-plane orientation is aligned to be perpendicular to cutting direction X. Then, the c-plane, which is perpendicular to the a-plane, is aligned parallel to cutting direction X by rotating support apparatus 360 without further tilting it out of plane until a maximum signal is measured using second x-ray module 320, comprising x-ray source 321a and x-ray detector 32 lb. In this way, sapphire boule 330 is aligned in 3-dimensions, with the c-plane parallel to the cutting direction and the a-plane perpendicular to it.

While preferably the boule is aligned with a processing tool (such as a saw) and the processed in place, it is also within the scope of the present invention that the boule can be aligned on the support apparatus against a marking or other indicator and then locked into position. The secured aligned boule can then be transported to a separate processing tool, and reposition against a corresponding marking or indicator in order to be further processed. Such an embodiment would be advantageous when the processing tool and support apparatus are in separate locations.

By properly aligning crystalline axes in three dimensions, improved properties are expected. For example, by cutting directly along the c-plane and perpendicular to the a-plane, a cylindrical sapphire core, having a substantially circular cross-sectional shape, or a sapphire brick having a rectangular prism shape, with a square cross-sectional shape, can be produced, with the cross-sectional shape parallel to the a-plane. From these, sapphire sheets and wafers can be produced with high yields and with maximum strength, with the plane of the sheets aligning with the appropriate crystal orientation and the thickness aligning with the other. It has been found that, even being a few degrees off of the c-plane, mechanical strength is compromised, as seen in an increase in cracked and damaged parts. Thus, a sapphire product having a geometry that aligns in three dimensions with the crystalline plane orientations can be produced by the method of the present invention, and it has been found that such products have improved and desirable properties. Furthermore, the method of the present invention provides additional flexibility in producing sapphire products with targeted crystalline orientations. For example, for some applications, a large and specifically targeted deviation from a particular crystalline plane can be advantageous. In particular, in example above, by aligning the c-plane to be 45 degrees from the direction of cutting, it has been found that thin sapphire sheets and wafers can be produced with good overall mechanical properties, along with an improved resistance to chipping when the part edges are precision cut or polished.

Thus, the method of the present invention provides a flexible process that enables the cutting and processing of sapphire materials, such as boules, with specifically targeted crystalline orientations in 3-dimensional space by using a crystalline material processing assembly having two or more x-ray modules in fixed positions both above and alongside the boule and a support apparatus that can be both tilted and rotated. Therefore, the present invention further relates to this crystalline material processing assembly.

The foregoing description of preferred embodiments of the present invention has been presented for the purposes of illustration and description. It is not intended to be exhaustive or to limit the invention to the precise form disclosed. Modifications and variations are possible in light of the above teachings, or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A method of producing a sapphire product comprising the steps of:

i) providing a sapphire product precursor having a first crystalline plane orientation and a second crystalline plane orientation;

ii)providing a crystalline material processing assembly device comprising:

a) a first x-ray module attached to the device and fixedly positioned at a first angle relative to a fixed cutting direction and configured to determine alignment of the first crystalline plane of the sapphire product precursor relative to the fixed cutting direction;

b) a second x-ray module attached to the device and fixedly positioned at a second angle relative to the fixed cutting direction and configured to determine alignment of the second crystalline plane of the sapphire product precursor relative to the fixed cutting direction; and c) a support apparatus for the sapphire product precursor attached to the device and tiltable and rotatable relative to the fixed cutting direction;

iii) placing the sapphire product precursor on the support apparatus;

iv) establishing alignment of the first crystalline plane via the first x-ray module and while the sapphire product precursor remains on the device, establishing alignment of the second crystalline plane of the sapphire product precursor via the second x-ray module to position the sapphire product precursor in the fixed cutting direction prior to any cutting steps following step i); and v) cutting the sapphire product precursor along the fixed cutting direction to produce the sapphire product.

2. The method of claim 1, wherein the first crystalline plane orientation is perpendicular to the second crystalline plane orientation.

3. The method of claim 1, wherein the first crystalline plane orientation is a c-plane orientation and the second crystalline plane orientation is an a-plane orientation.

4. The method of claim 2, wherein the fixed cutting direction is perpendicular to the first crystalline plane orientation and is parallel to the second crystalline plane orientation.

5. The method of claim 1, wherein the sapphire product precursor has a cylindrical cross sectional shape.

6. The method of claim 1, wherein the sapphire product precursor is a sapphire boule.

7. The method of claim 1, wherein the sapphire product precursor comprises single crystal sapphire prepared in a crystal growth furnace.

8. The method of claim 7, wherein the crystal growth furnace is a heat exchanger method furnace.

9. The method of claim 1, wherein the sapphire product has a cylindrical shape.

10. The method of claim 9, wherein the sapphire product has a substantially circular cross-sectional shape in a direction parallel to either the first crystalline plane orientation or the second crystalline plane orientation.

11. The method of claim 1, wherein the sapphire product has a rectangular prism shape.

12. The method of claim 11, wherein the sapphire product has a substantially rectangular cross-sectional shape in a direction parallel to either the first crystalline plane orientation or the second crystalline plane orientation.

13. The method of claim 1, wherein the support apparatus comprises a flat platform upon which the sapphire product precursor is placed.

14. The method of claim 1, wherein the sapphire product precursor is cut with a saw.

15. The method of claim 1, wherein the step of cutting the sapphire product precursor comprises cutting a cylindrical core.

16. The method of claim 1, wherein the step of cutting the sapphire product precursor comprises cutting a rectangular prismatic brick.

17. A crystalline material processing assembly device for aligning a sapphire product precursor having a first crystalline plane orientation and a second crystalline plane orientation in preparation for a cutting operation along a fixed cutting direction, the crystalline material processing assembly comprising:

a) a first x-ray module attached to the device and fixedly positioned at a first angle relative to the fixed cutting direction and configured to determine alignment of the first crystalline plane of the sapphire product precursor relative to the fixed cutting direction;

b) a second x-ray module attached to the device and fixedly positioned at a second angle relative to the fixed cutting direction and configured to determine alignment of the second crystalline plane of the sapphire product precursor relative to the fixed cutting direction while the sapphire product remains on the device, wherein aligning the first crystalline plane and the second crystalline plane establishes the fixed cutting direction; and c) a support apparatus for the sapphire product precursor attached to the device and tiltable and rotatable relative to the fixed cutting direction, wherein the support apparatus tilts or rotates the sapphire product precursor to establish the fixed cutting direction based on the determined alignment of the first crystalline plane and the determined alignment of the second crystalline plane.

* * * * *